US005810223A

United States Patent [19]

Helm

[11] Patent Number: 5,810,223

[45] Date of Patent: Sep. 22, 1998

[54] BRIEFCASE CARRIER

[76] Inventor: Eric George Helm, P.O. Box 1619, N. Falmouth, Mass. 02556

[21] Appl. No.: 788,578

[22] Filed: Jan. 27, 1997

[51] Int. Cl.[6] ..... A45F 3/14

[52] U.S. Cl. ..... 224/250; 224/259

[58] Field of Search ..... 224/250, 259

[56] References Cited

U.S. PATENT DOCUMENTS

| | | | |
|---|---|---|---|
| 922,046 | 5/1909 | Royce | 190/200 |
| 2,769,475 | 2/1956 | Fisher | 190/900 |
| 4,088,252 | 5/1978 | Grunberger | 190/200 |
| 4,127,223 | 11/1978 | Uchin | 224/250 X |
| 4,257,463 | 3/1981 | Monaco | 190/900 |
| 4,518,107 | 5/1985 | Amos | 224/259 X |
| 4,809,896 | 3/1989 | McColly | 224/259 |
| 4,972,981 | 11/1990 | Gex | 224/250 X |
| 5,083,692 | 1/1992 | Treese | 224/250 X |
| 5,131,513 | 7/1992 | Gossage | 190/200 |

FOREIGN PATENT DOCUMENTS

| | | |
|---|---|---|
| 276083 | 7/1914 | Germany . |
| 693272 | 7/1940 | Germany . |

*Primary Examiner*—Renee S. Luebke
*Attorney, Agent, or Firm*—Patent Trademark Services; Joseph H. McGlynn

[57] ABSTRACT

An improved carrying device for briefcases and similar items is disclosed. The invention may be used to carry a briefcase on the back of the user. A tapered support portion, consisting of heavily woven nylon, is attached to a horizontal securing strap and two shoulder straps. The securing strap is adjustable and is wrapped around the briefcase. The shoulder straps fit over the shoulders of the user. The shoulder straps support the underside of the briefcase, and the support portion holds the back surface thereof. The securing strap restricts lateral shifting of the briefcase while walking. The briefcase may be carried vertically or horizontally relative to the user's body.

14 Claims, 1 Drawing Sheet

BRIEFCASE CARRIER

BACKGROUND OF THE INVENTION

The present invention relates generally to personal carrying devices, and in particular to a carrier for briefcases and the like, comprising shoulder straps, a flexible supporting member, and a fastening strap.

DESCRIPTION OF THE PRIOR ART

Business people, college students, and schoolchildren are often required to carry a substantial amount of papers, books, and other effects from place to place. Transporting these items is especially tiresome for professionals who carry, for the sake of storage space and organization, a conventional briefcase. A number of devices have been disclosed to make transporting items easier and more convenient. However, as described below, the prior art has not adequately addressed the need for a carrier that is adaptable to a conventionally styled, briefcase-type container.

U.S. Pat. No. 4,257,463 discloses a combination attache case and handbag apparatus with a detachable shoulder strap. A flexible document carrier, capable of being rolled up, is disclosed in U.S. Pat. No. 5,131,513. U.S. Pat. No. 2,769,475 describes a thin carrying case having a retractable strap attached to a reel mechanism. These devices do little to reduce the strain of carrying heavy items, since they require the user to place all the weight of the items on one side of the body. Moreover, they are of little use to those who require the storage space, organization, and stylistic advantages of a conventional briefcase.

U.S. Pat. No. 415,117 describes a carrying device consisting of rectangular, telescopically connecting parts. This invention, while providing ample storage, is extremely bulky and awkward to carry. It is also not stylistically acceptable for business professionals. Similarly, the school satchel described in U.S. Pat. No. 4,088,252 is not useful for professional people. It comprises an accordion bag and shoulder straps, and is made to be worn on the back of a child.

German Patent No. 693,272 describes a flexible satchel with shoulder straps channeled through the top edge. The shoulder straps may be pulled to close the satchel. German Patent No. 276,083 discloses a carrier with a back pouch and shoulder straps. These inventions cannot be stored easily, and are too bulky and cumbersome to be used by professional people.

There clearly remains a need in the art for a carrier that reduces the strain of transporting a conventional briefcase. Professional people are in need of a briefcase carrier that is inexpensive, lightweight, and easy to store, so that the carrier may be placed inside the briefcase when the person reaches his or her place of work. The device disclosed herein allows the user to easily and conveniently transport items hands free without sacrificing the organizational and stylistic advantages of the conventional briefcase.

SUMMARY OF THE INVENTION

The present invention is a carrying device, primarily but not exclusively for use with a briefcase. The invention is designed to be worn on the back of the user, to ease the strain associated with carrying a heavy briefcase on one side of the body. The invention comprises a flexible support portion, a strap for securing the briefcase, and shoulder straps. The straps are adjustable, to fit various body sizes and briefcase dimensions. The invention may be constructed from nylon or any other lightweight, durable, and inexpensive material.

Accordingly, it is an object of the present invention to provide an improved carrying device.

It is a further object of this invention to provide an improved carrying device that is inexpensive, lightweight, convenient, and easy to store.

It is still further an object of this invention to provide an improved carrying device that may be used to transport a conventional briefcase or similar shaped container or object.

Another object of this invention is to provide an improved carrying device which reduces the strain of carrying items such as a briefcase.

These and other objects and advantages of the present invention will become apparent from the detailed description below, when taken in conjunction with the annexed drawings.

DESCRIPTION OF THE PREFERRED EMBODIMENT

Figure 1:
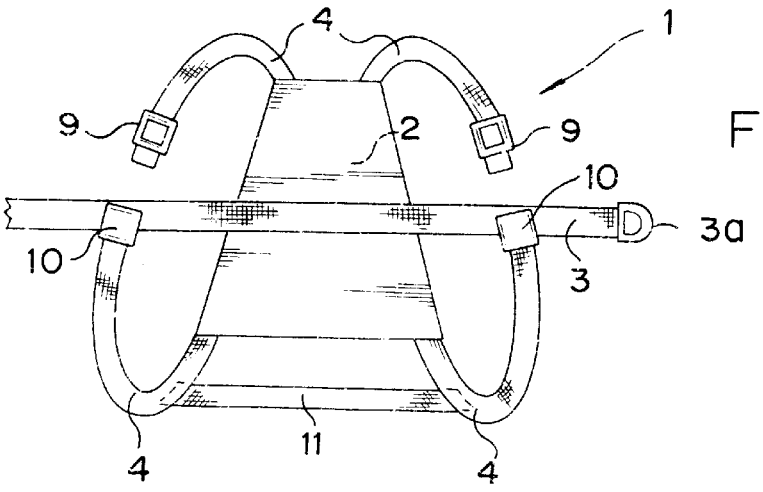
FIG. 1 shows a front view of the present invention.

Referring now to the drawings in greater detail, it can be seen in FIG. 1 that the present invention 1 comprises a support portion 2, a securing strap 3, and shoulder straps 4. The support portion 2 is constructed of thickly woven nylon fabric, or some similar material. The shoulder straps 4 are connected at the bottom and top of the support portion 2 by any conventional means such as, but not limited to, sewing. The shoulder straps 4 are detachable and adjustable by means of a conventional quick release/buckle combination device 9, 10 as is used on knapsacks or backpacks.

The securing strap 3 is affixed horizontally across the support portion 2 by any conventional means. The shoulder straps 4 and the securing strap 3 are also preferably constructed from nylon or some similar material, and may be sewn or otherwise securely attached to the support portion 2.

The shoulder straps 4 also may be padded with nylon-covered polyurethane foam strips, which could be sewn to the shoulder straps 4. Of course, different materials and modes of attachment may be used without departing from the scope of the invention. The length of strap 11 can be secured by any conventional means between straps 4 to minimize separation of the straps.

Figure 2:
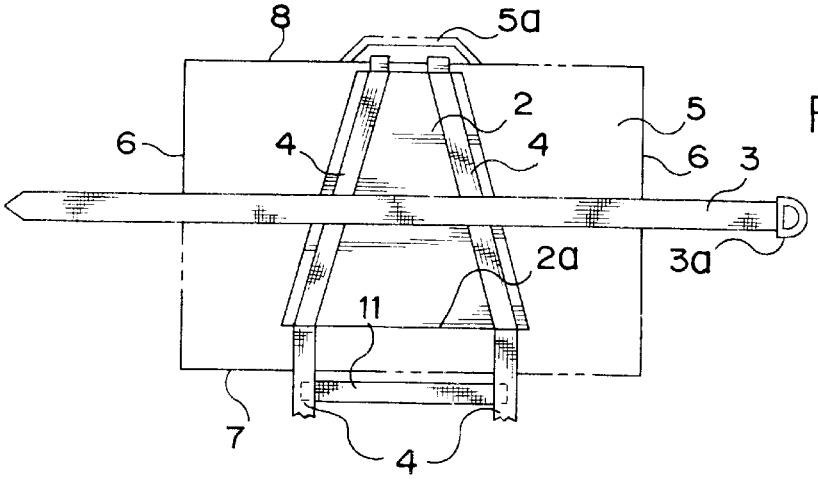
FIG. 2 shows a back view of the present invention with a briefcase in the horizontal position.
Figure 3:
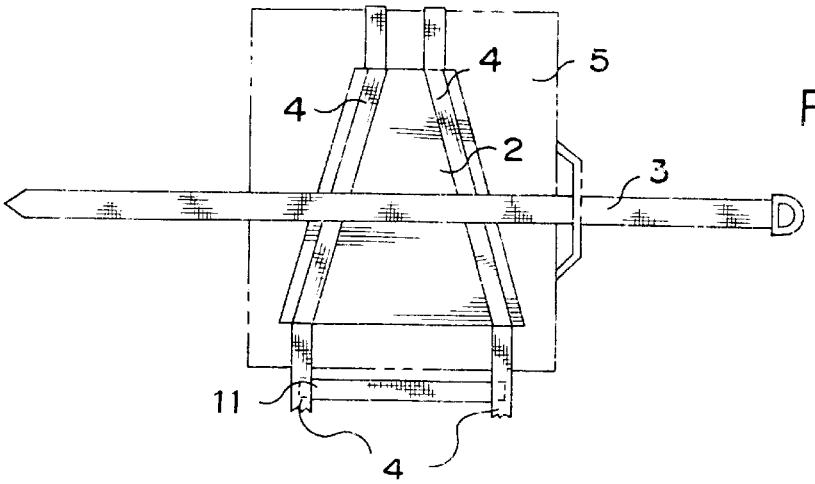
FIG. 3 shows a view similar to that in FIG. 2, with a briefcase in the vertical position.

FIGS. 2 and 3 depict the invention 1 attached to a briefcase 5. As shown in FIGS. 2 and 3, the support portion 2 is disposed across one surface (i.e. the surface extending between the sides 6) of the briefcase 5. The support portion 2 is tapered from top to bottom, so that the shoulder straps 4 may fit through or over the top of the handle 5*a*, attached to the top 8 of the briefcase, when the briefcase 5 is secured horizontally relative to the user's body, as shown in FIG. 2. The wider portion 2*a* adjacent the bottom 7 of the briefcase gives more balanced support to the briefcase and, therefore, holds it more securely against the user's back.

When the briefcase 5 is secured vertically, as shown in FIG. 3, the securing strap 3 fits through the handle 5*a*. As shown in FIG. 3, shoulder straps 4 support either side of the briefcase 5, and the support portion 2 supports the back surface of the briefcase 5. The securing strap 3 prevents lateral shifting of the briefcase 5. Securing strap can hold the case alone to the back or can go completely around the case and the user's waist. If used around the case alone, a separate detachable waist strap could be used if desired. With the possible exception of bike riding, neither a waist strap or extending the securing strap around the waist is really necessary. Waist securing would be an option. Also, the case is held better when a strap is only used around the case itself.

The securing strap 3 is of sufficient length that it may extend around the briefcase 5 and be secured by means of a closure 3*a*. The closure 3*a* is shown in FIGS. 1 and 2 as a metal ring, which receives the opposite end of the securing strap 3. Different means of connecting the ends of the securing strap 3 may be used without departing from the scope of the invention. The securing strap 3 may be simply tied to the closure 3*a*, or the securing strap 3 may be provided with hook-and-loop closure pads (not shown). The closure 3*a* may also consist of a belt-type buckle, which could receive holes punched in the opposite end of the securing strap 3. Any adjustable means of attaching the ends of the securing strap 3 may be used without departing from the scope of the invention.

The shoulder straps 4 are provided with quick release, detachable adjustable buckles 9. These buckles 9 are shown in FIG. 1 as the slide-type device commonly known in the art, wherein opposite ends of the straps 4 are received into slits and may be tightened therein. Again, however, other suitable means of adjusting the shoulder straps 4 may be used.

To use the invention 1, if it is desirable to secure the briefcase 5 horizontally to the body, as shown in FIG. 2, the top portion of the shoulder straps 4 are detached and inserted through the handle 5*a* of the briefcase 5 and then attached to the bottom portion of straps 4. The user's arms are then inserted through the straps 4. To restrict unwanted movement of the briefcase while walking, riding a bike, or performing some other activity, the securing strap 3 is wrapped around the briefcase 5 and tightly secured by means of the closure 3*a*. If it is desirable to secure the briefcase vertically, as shown in FIG. 3, the securing strap 3 is inserted through the handle 5, which will restrict unwanted shifting of the briefcase 5. The shoulder straps 4 are placed over the shoulders of the user and adjusted snugly.

The invention 1 thus holds the briefcase 5 securely on the back of the user, thereby reducing the strain associated with carrying the briefcase on one side of the body, as is commonly done. The weight of the briefcase 5 is supported underneath by the shoulder straps 4 and on the back surface by the support portion 2, so the briefcase is carried very closely to the user's back, further reducing strain on the user. The invention 1 is lightweight and discreet, and may be easily stored inside the briefcase when not in use. It may be inexpensively manufactured and attractively colored to suit individual preferences.

Although the briefcase carrier and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A briefcase carrier in combination with a briefcase having a handle, said briefcase carrier comprising:

support means for attachment of a briefcase to a body of a user, said support means having top, bottom and side portions, carrying means having a length and fastened to said support means at said top and bottom portions, securing means fastened to said support means for securing said briefcase to a user's body, and means attached to said carrying means for fastening said carrying means to said top portion of said support means, and wherein said briefcase is oriented vertically with respect to said support means and said securing means is passed through said handle of said briefcase.

2. The briefcase carrier of claim 1, herein said support means is constructed of a thickly woven nylon fabric.

3. The briefcase carrier of claim 1, wherein said carrying means is a pair of shoulder straps constructed of heavy duty nylon woven material which are securely fastened to said support means at the bottom and top portions of said support means.

4. The briefcase carrier of claim 1, wherein said support means is shaped as a truncated triangle.

5. The briefcase carrier of claim 1, wherein said carrying means have means for adjusting the length of said carrying means.

6. The briefcase carrier of claim 1, wherein said securing means is a strap which is affixed horizontally to said carrying means.

7. The briefcase carrier of claim 1, wherein said carrying means pass underneath said brief case and said brief case is positioned between said support means and a user's back.

8. A briefcase carrier in combination with a briefcase having a handle, said briefcase carrier comprising:

support means for attachment of a briefcase to a body of a user, said support means having top, bottom and side portions, carrying means having a length and fastened to said support means at said top and bottom portions, securing means fastened to said support means for securing said briefcase to a user's body, and means attached to said carrying means for fastening said carrying means to said top portion of said support means, and wherein said briefcase is oriented horizontally with respect to said support means and said carrying means is passed through said handle of said briefcase.

9. The briefcase carrier of claim 8, wherein said support means is constructed of a thickly woven nylon fabric.

10. The briefcase carrier of claim 8, wherein said carrying means is a pair of shoulder straps constructed of heavy duty nylon woven material which are securely fastened to said support means at the bottom and top portions of said support means.

11. The briefcase carrier of claim 8, wherein said support means is shaped as a truncated triangle.

12. The briefcase carrier of claim 8, wherein said carrying means have means for adjusting the length of said carrying means.

13. The briefcase carrier of claim 8, wherein said securing means is a strap which is affixed horizontally to said carrying means.

14. The briefcase carrier of claim 8, wherein said carrying means pass underneath said brief case and said brief case is positioned between said support means and a user's back.

* * * * *